United States Patent [19]

Legille et al.

[11] Patent Number: 4,720,226

[45] Date of Patent: Jan. 19, 1988

[54] AUTOMATED APPARATUS FOR LINING THE INNER WALL OF A VESSEL WITH BRICKS

[75] Inventors: Edouard Legille, Luxembourg; Emile Lonardi, L-Bascharage; Victor Kremer, Luxembourg, all of Luxembourg

[73] Assignee: Paul Wurth S.A., Luxembourg, Luxembourg

[21] Appl. No.: 937,587

[22] Filed: Dec. 3, 1986

[30] Foreign Application Priority Data

Dec. 3, 1985 [LU] Luxembourg ..... 86189

[51] Int. Cl.[4] ..... E04G 21/16

[52] U.S. Cl. ..... 414/10; 52/747; 266/281; 294/63.1; 414/608

[58] Field of Search ..... 414/10, 608; 266/281; 52/747, 749; 187/2; 182/128; 294/63.1

[56] References Cited

U.S. PATENT DOCUMENTS 3,955,685 5/1976 Smith ..... 414/10

FOREIGN PATENT DOCUMENTS 58251 8/1982 European Pat. Off. .
3344261 8/1984 Fed. Rep. of Germany .
1325256 3/1963 France .
1544984 9/1968 France .

*Primary Examiner*—Leslie J. Paperner
*Attorney, Agent, or Firm*—Fishman & Dionne

[57] ABSTRACT

The apparatus comprises a work platform vertically movable within a vessel and capable of rotating about the vertical axis of the vessel. The work platform is provided with two storage areas for pallets of bricks, and an automatic device for manipulating and laying the bricks. The apparatus also includes a palletholder housing comprising at least two compartments for respectively receiving a full pallet and an empty pallet, a basket for carrying the housing, and lifting devices for raising and lowering the basket, together with the pallet-holder housing to the level of the platform and for releasing the pallet-holder housing from the basket. The apparatus is particularly well suited for repairing the refractory lining of a metallurgical convertor.

20 Claims, 6 Drawing Figures

AUTOMATED APPARATUS FOR LINING THE INNER WALL OF A VESSEL WITH BRICKS

BACKGROUND OF THE INVENTION

This invention relates to an automated apparatus for lining the inner wall of a vessel with bricks. More particularly, this invention relates to a brick laying apparatus comprising a work platform which is vertically movable within the vessel and capable of rotating about the vertical axis of the latter. The work platform is provided with two brick-pallet storage areas and with automatic brick manipulating and laying means.

Although not being limited thereto in its utility, the present invention is aimed more particularly at an apparatus for laying a refractory lining on the inner wall of a metallurigical convertor.

Various apparatuses of this type (see, for example, German Patent Document No. DE-AS-1, 154, 131 and Belgium Patent No. BE-A-760,355) have already been proposed for the purpose of automatically carrying out a job (bricklaying in a metallurigical vessel) which has heretofore usually been carried out manually under extremely difficult conditions.

Unfortunately, the proposed apparatuses have not solved all of the outstanding problems, and consequently, even now, it is still not possible to achieve the benefits associated with complete automation of the operation of lining convertors with bricks.

In this respect, it will be appreciated that the bricks have a tapered conical shape, so that they can be laid in a circle in accordance with the cross-section of the convertor. It will further be appreciated that not only are all convertors not of the same size, but also the diameter of each convertor varies according to its height (because convertors usually have a substantially oval vertical cross-section). Since it is difficult to make bricks to measure, two specific types of bricks of differing conicity are manufactured. By carefully alternating between these two types, the desired curvatures of a particular convertor are obtained. That means that two pallets of bricks (one of each type), must be continuously available on the work platform, so that the robot laying the bricks can automatically make the proper selection according to an automatic bricklaying control.

The brick pallets are raised or lowered on the platform by means of a hoist, and once the pallets are level with the platform, are loaded onto a movable carriage which shifts the pallets horizontally onto their respective storage areas. To ensure that the apparatus can function correctly in an automated manner, each brick pallet must always be placed at a very precise location; and the bricks must always be arranged on the pallets accurately and in the same way; and must always be oriented in the same way relative to one another and relative to the platform and to the manipulating robot. This condition becomes even more complicated because the platform must be capable of rotating about the vertical center axis of the vessel to allow the robot to reach the entire brick-lining circumference. Consequently, the system for moving the pallets must function accurately and in a constant manner, without any jolting, in order to prevent the bricks from being shifted on the pallets and possibly falling therefrom. Moreover, the system must be associated with detection means for continuously monitoring the correct position of the pallets and bricks.

Another problem with automatic bricklaying apparatuses is the overcrowding of the platform. When the pallets are raised on the platform, the hoists and winches provided for this purpose are installed on the platform. The pulleys and cables associated with the hoists and winches impede the movement of the manipulating robot and are a constant danger to the personnel located on the platform.

The empty pallets can also cause problems of overcrowding. In fact, when a full pallet is raised or lowered on the platform, the empty pallet first must be removed so that the full pallet can be transferred onto the carriage, before the empty carriage is attached to the hoist in order to be carried away. Another possibility would be to lower the empty pallet first before raising a full pallet, but this is undesirably time consuming.

SUMMARY OF THE INVENTION

The above-discussed and other problems and deficiencies of the prior art are overcome or alleviated by the automated bricklaying apparatus of the present invention. The present invention includes a pallet-holder housing comprising at least two superimposed compartments for respectively receiving a full pallet and an empty pallet; a basket for supporting the pallet holding housing; and lifting means for raising or lowering the basket, together with the pallet-holder housing, to the level of the platform and for releasing the pallet-holder housing from the basket. The present invention also includes means for placing an empty pallet in the housing and removing the full pallet therefrom.

The lifting means preferably comprises a first winch-type lifting device mounted under the platform in order to raise the basket and the housing, together with a pallet of bricks, towards a stand-by position underneath the platform. Also, a second lifting device is similarly mounted under the platform in order to remove the pallet-holder housing from the basket and hoist it through a central orifice, provided for this purpose in the platform, up to the level of the latter.

Since the two lifting devices are mounted under the platform, their respective cables and winches do not crowd the surface of the platform and do not impede the movement of the depalletizing and bricklaying robot. Significantly, as a result of the important design of the hoist in the form of two separate lifting devices, it has become possible to arrange the entire bricklaying system under the platform and nevertheless make it capable of hoisting the pallets up to the level of the platform. Moreover, this novel construction of the lifting system has been made possible because of the pallet-holder housing and its transport basket with the first lifting device acting on the basket and the second lifting device on the housing.

The pallet-holder housing, which is one of the important features of the present invention, is preferably constructed in the form of a rack having four legs. The rack has a depth substantially equal to the length of the bricks and includes a lower compartment for the full pallets and an upper compartment for the empty pallets. The top portion of the housing is preferably designed as a container for receiving broken bricks.

The basket, which is also one of the important features of the present invention, comprises a rectangular floor substantially corresponding to the horizontal cross-section of the housing and is provided, at the four corners thereof, with notches for the passage of the legs of the housing. Two vertical panels which are located on opposing longitudinal sides of the floor have a height which is at least equal to the height of the lower compartment of the housing. Also, lugs are provided on opposing lateral sides of the floor for attaching the lifting cables of the first lifting device.

The vertical panels of the basket preferably have a height corresponding to the sum of the height of the lower compartment and half the height of the upper compartment. In this way, the lower compartment of the housing is completely closed and the upper compartment is at least partially closed when the housing is engaged in the basket, thus preventing the bricks (and possibly the pallet) from sliding out of the housing if the latter is not lifted horizontally, or if it swings when it is suspended from the lifting cable, or if it strikes against an obstacle. Another advantage of this basket configuration is that the pallets have to be correctly positioned in the housing and the bricks also have to be positioned correctly on the pallet, without projecting laterally, otherwise it is not possible to engage the housing on the basket or vice versa. The lugs of the basket preferably have a height at least equal to half the height of the lower compartment of the pallet-holder housing. This feature ensures that the center of gravity of the assembly (consisting of the basket and housing) is located below the fastening points of the lifting cables, thus improving stability during raising and lowering.

Limit detectors are provided on the lower edge of the central orifice of the platform and are actuated by fingers arranged at corresponding locations on the upper edges of the longitudinal panels of the basket. These limit detectors function to determine the stand-by position and automatically control the stopping of the first lifting device when the stand-by position is reached. There are preferably four detectors and corresponding hinges, all of which are part of a monitoring circuit making it possible to ascertain whether the four detectors have been actuated simultaneously; in other words, to check whether the housing reaches the stand-by position horizontally.

In accordance with a preferred embodiment of the present invention, the second lifting device comprises two pairs of pivoting lifters arranged at locations corresponding respectively to the positions of the four legs in the stand-by position, and sliding vertically along two pairs of rails under the action of two jacks. Each pair of lifters is mounted pivotably on a crossmember, so as to occupy a raised position aside from the legs of the housing when the second lifting system is out of action.

To ensure correct orientation of the pallets and bricks, with dependence on the angular position of the platform, a turntable which rotates at the same time as the platform, but which always returns automatically to an angular initial position is provided on the ground, at the location where the pallets are picked up. The pallets can thus be placed on the turntable by means of a fork-lift truck which can always approach the turntable from the same direction. Before the basket is attached by means of the cables of the first lifting device, the turntable is rotated at an angle corresponding to the orientation of the platform relative to the initial position.

The above-discussed and other features and advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
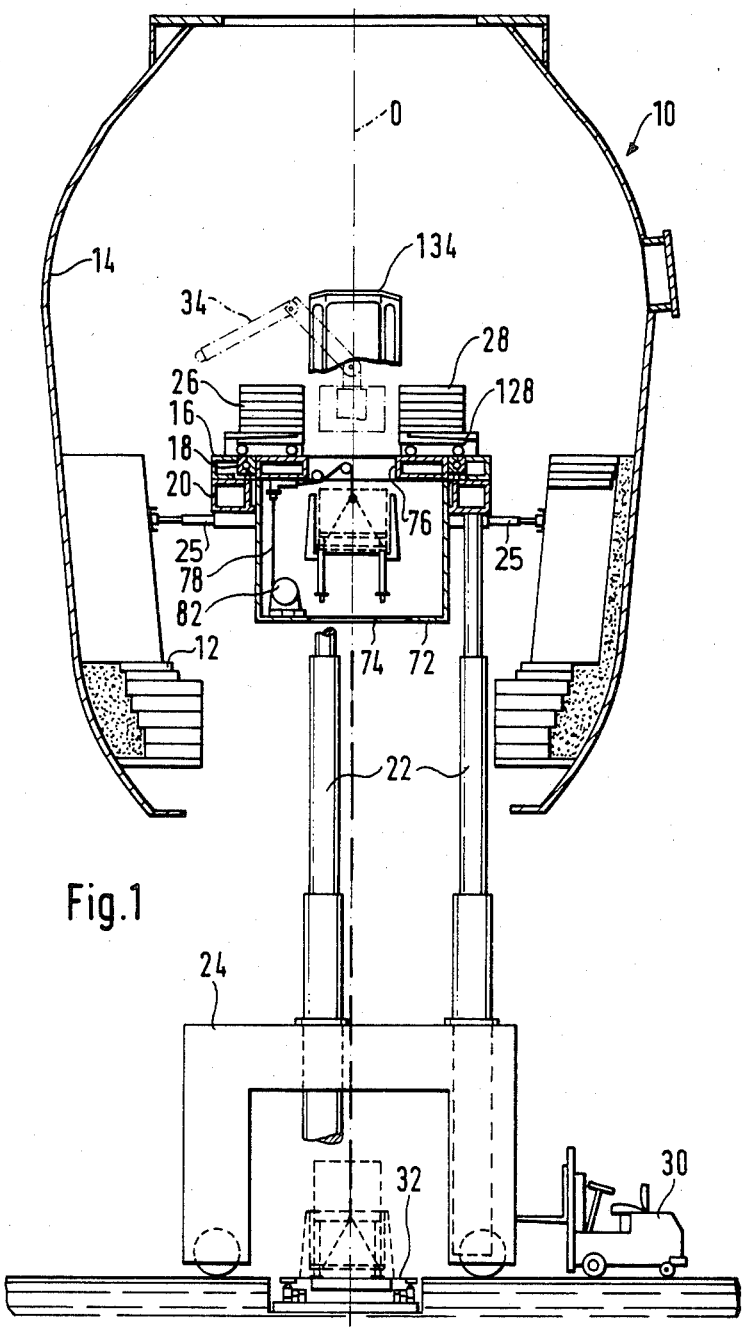
FIG. 1 is a front elevation view of an apparatus for lining the inner wall of a convertor with bricks in accordance with the present invention.

FIG. 1 shows a metallurigical convertor 10 which consists of a metal wall 14 with the start of a refractory lining 12 comprised of a stack of refractory bricks laid on top of one another by means of an apparatus in accordance with the present invention. This apparatus comprises a platform 16 resting on an annular support 20 by means of a bearing 18. Support 20 is carried by several, for example three, telescopic masts 22 actuated hydraulically in order to raise platform 16 through the open bottom of convertor 10 and move the platform axially within the convertor. Telescopic masts 22 can form part of a travelling undercarriage 24 resting on the work floor underneath the convertor.

Annular support 20 has a series of radial props 25 for propping support 20 against the inside of the refractory covering and for stabilizing platform 16, to allow the latter to rotate relative to the support 20 without generating excessive vibration and to prevent oscillations attributable to the movement of the robot.

The brick pallets (two of which are located on platform 16 and are generally identified by reference numerals 26 and 28), are brought vertically below platform 16, for example by means of a fork-lift truck 30. In accordance with one feature of the present invention, pallets 26 and 28 are placed below platform 16 on a turntable 32.

Turntable 32 can rotate about the axis 0 by means of a suitable suspension, for example a roller suspension, this rotation being coordinated with the rotation of platform 16. In fact, platform 16 must be capable of rotating about the axis 0, so that the depalletizing and bricklaying robot, represented by reference numeral 34, can reach the entire perimeter of the convertor. For example, each time robot 34 has completed a sector, platform 16 is advanced by a certain angle, for example, 60°, so that the robot can cover the following sector. Turntable 32 is rotated through the same angle at the same time as platform 16. When fork-lift truck 30 brings a pallet of bricks, turntable 32 returns to an initial angular position which is always the same. As soon as the pallet is placed on the turntable, the latter rotates so as to occupy an angular position corresponding to that of platform 16, before the pallet is lifted by the lifting cables. Another possibility is to keep turntable 32 in a loading position and rotate it into the desired position, when required. As a result, fork-lift truck 30 can always bring the pallets in the same direction and nevertheless raise the pallets to the correct orientation which corresponds to the location on platform 16.

Figure 3:
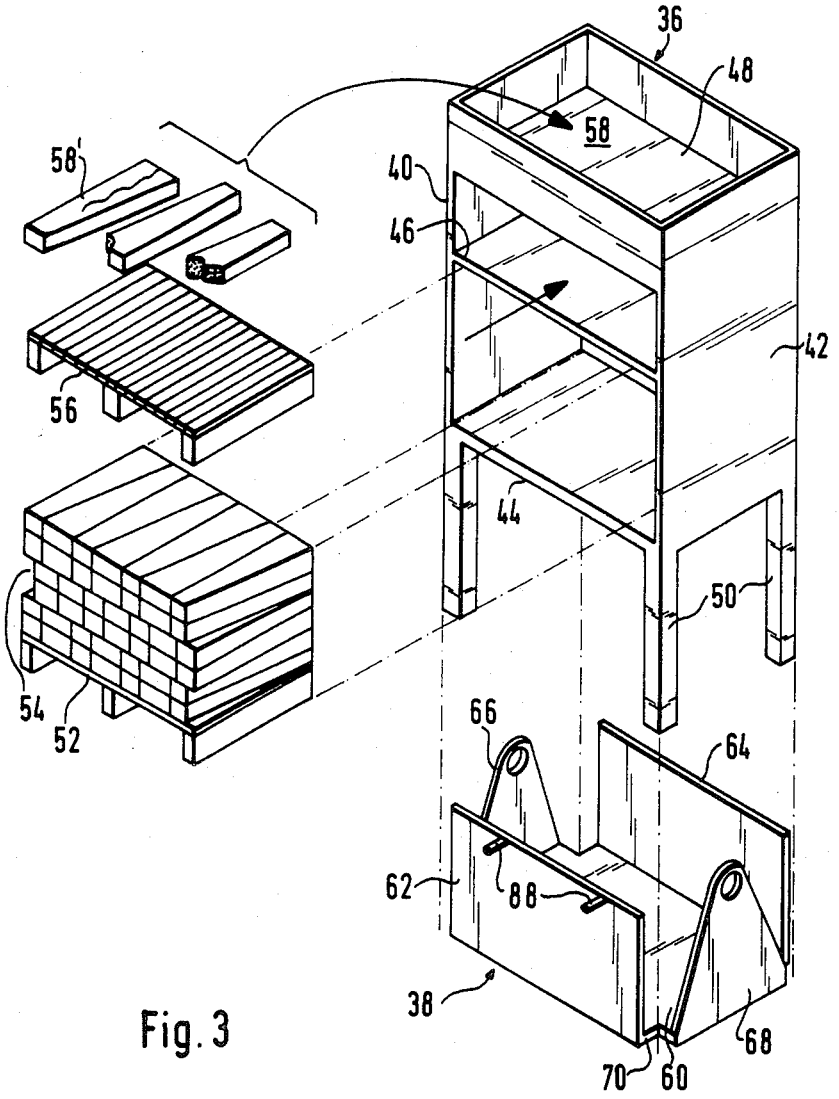
FIG. 3 is an exploded perspective view of the pallet-holder housing and basket.

In accordance with an important feature of the present invention, the pallets are raised onto the platform by means of a pallet-holder housing 36 and a basket 38 illustrated in FIG. 3. Housing 36 comprises two side walls 40 and 42 connected to one another by means of three superimposed rectangular shelves 44, 46 and 48, and equipped with four identical legs 50. The lower compartment, defined by lower shelf 44, the intermediate shelf 46 and the two side walls 40 and 42 is intended for receiving a pallet loaded with bricks 54. The upper compartment located between intermediate shelf 46 and upper shelf 48 is reserved for empty pallets 56. Because the front and back of the housing are open, the empty and full pallets can be equally introduced and extracted from either one side of the housing or the other. Thus, it will be appreciated that housing 36 has an identical configuration from both the front and back.

The depth of housing 36 is equal to the width of pallets 52 and bricks 54, so that the alignment of the bricks at the back and front of housing 36 ensures the correct positioning of bricks 54 on a pallet 52 (and of the latter relative to housing 36).

The upper shelf 48 also forms the bottom of a container 58 surrounded by projecting side walls 40 and 42 and longitudinal edges at the front and back which connect the edges formed by side walls 40 and 42. Container 58 is intended to receive bricks which cannot be used, such as, for example, broken or cracked bricks 58', and makes it possible to benefit from the lowering of the empty pallets to eliminate this type of brick 58' from the work platform.

Basket 38 consists of a rectangular floor 60, the surface of which corresponds substantially to the horizontal cross-section of housing 36. Basket 38 further includes two rectangular longitudinal panels 62 and 64 erected vertically on floor 60 and two lateral lugs 66 and 68 provided with orifices for attaching lifting cables. Floor 60 also has, at the four corners thereof, notches 70 of a shape and location corresponding respectively to the cross-sections and locations of legs 50 of housing 36, so that housing 36 and basket 38 can be fitted vertically into one another, as shown in FIG. 2.

Figure 2:
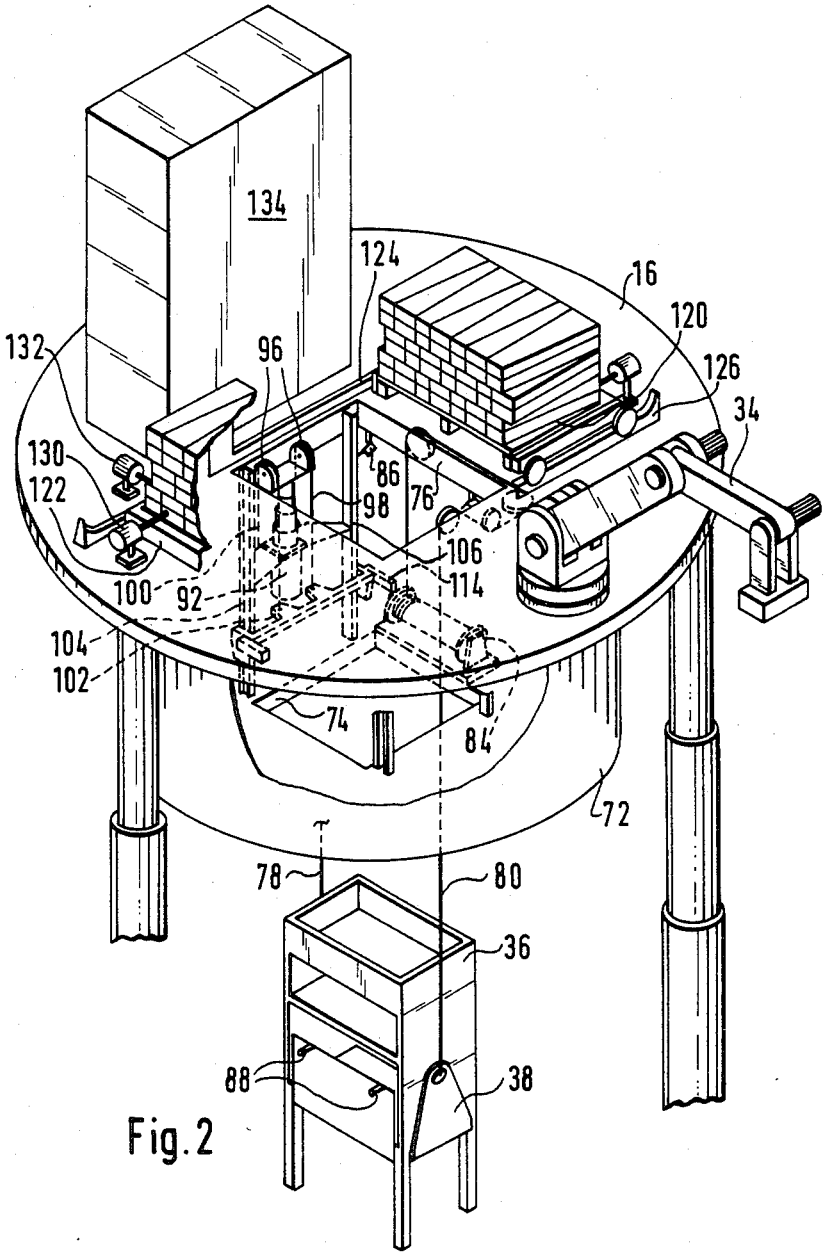
FIG. 2 is a partial perspective view of the upper part of the apparatus of FIG. 1.

The lateral panels 62 and 64 of basket 38 are of sufficient height to ensure that they completely seal the lower compartment of housing 36 and at least partially seal the upper compartments when the housing is carried by basket 38, as shown in FIG. 2. This arrangement has several advantages. First of all, bricks 54 are effectively held in place, this being important for positioning them correctly for the purpose of automatic depalletization on the platform. Furthermore, neither the bricks nor the pallets can slide out of housing 36 and risk causing an accident when they fall.

Moreover, if a brick 54 were not positioned correctly or the pallets were not correctly engaged in their respective compartments, it would be impossible to engage basket 38 on housing 36 or vice versa. In other words, the fact that it is possible to engage basket 38 on housing 36, as shown in FIG. 2, ensures that the bricks 54 are correctly positioned.

Lugs 66 and 68 of basket 38 are sufficiently high and preferably extend up to the region of intermediate shelf 46 of housing 36, so that the center of gravity of the assembly (consisting of housing 36 and basket 38) is located at a level below that where basket 38 is attached to the lifting cables. Such an assembly improves the loading stability.

In accordance with another feature of the present invention, the lifting system is arranged underneath platform 16 in a casing 72. Both the bottom of casing 72 and platform 16 have a central rectangular orifice 74 and 76 allowing the pallet-holder housing 36 to pass therethrough. The pallets are raised onto platform 16 in two steps. A first lifting system serves to raise housing 36 into casing 72 by means of a pair of cables 78 and 80 attached to the lugs of basket 38. Cables 78 and 80 move about a series of guide and return pulleys mounted under platform 16 around orifice 76 and are wound onto a pair of winches 82 and 84, (one of these winches being shown in FIG. 1 and the other in FIG. 2). Winches 82 and 84 are installed on the bottom of casing 72 on either side of orifice 74. To ensure that housing 36 is raised horizontally, it is of course necessary for winches 82 and 84 to operate in perfect synchronization. To make it easier to synchronize the raising of the two cables 78 and 80, it is also possible to wind them onto a single winch divided into two axial parts.

The winch or winches for winding cables 78 and 80 possess means (not shown, but known per se), of reducing the lifting speed when housing 36 penetrates into casing 72, this being carried out progressively as the housing approaches the level of platform 16.

This end of travel of housing 36 is illustrated in FIGS. **4*a* and 4*b*. From the moment when housing 36 penetrates into housing 72, as shown in FIG. 4*a*, its speed is reduced progressively up to the moment it reaches the position of FIG. 4*b*. The stopping of the winches is determined and controlled automatically by limit detectors represented diagrammatically by the reference numeral 86 and mounted on the edges of orifice 76 in platform 16. Detectors 86 are actuated by fingers 88 arranged at corresponding locations on the lateral panels of basket 38. Detectors 86 can consist of well-known electromechanical sensors or of other known sensors. It is preferable to provide two fingers 88 (see FIG. 3) on each of panels 62 and 64 of basket 38 and four corresponding detectors 86. Detectors 86 are preferably associated with shock-absorbers known per se, to ensure progressive stopping and to absorb the inertia of housing 36**.

Whatever the number of detectors, and even if basket 38 is not horizontal, as soon as one of them is acutated, the two winches 82 and 84 are stopped atuomatically, leaving housing 36 in the stand-by position illustrated in FIG. **4*b***.

A second lifting system serves for hoisting housing 36 from the stand-by position to the position shown in FIG. **4*c*, so as to bring the pallet located in the lower compartment of housing 36 up to the level of platform 16**.

This second lifting device comprises two hydraulic jacks 92 and 94 or motors mounted under platform 16 in casing 72 on either side of orifices 74 and 76. As emerges more clearly from FIG. 2, the rod of each of the jacks 92 and 94, which is preferably telescopic, carries a pair of pulleys 96, about which pass two cables or chains 98 and 100 which are fastened at one of their ends to casing 72 or to jack 92 and 94; and at the other end to a crossmember 102 vertically movable between a pair of lateral rails 104 and 106.

The opposite jack 94, which can only be seen in FIG. 4, acts in the same way as jack 92, by means of two pulleys and two cables, on a crossmember 108 vertically movable between two lateral rails.

The activation of jacks 92 and 94, which must of course be operated at the same time and in synchronism, causes crossmembers 102 and 108 to rise along their respective rails. The distance covered by crossmembers 102 and 108 is double that covered by the rods of jacks 92 and 94 because of the return of the cables over the pulleys.

Each of crossmembers 102 and 108 has a pair of lifters 110, 114 and 116, 118 respectively. These lifters are mounted on the ends of the crossmembers in the form of pivoting pawls, so that, in the operative position, they are in the path of legs 50 of housing 36. When the crossmembers 104 and 108 are in the inoperative position, that is, in the low position, these lifters pivot into an inoperative position under the action of a raised rim 74*a* about the orifice 74 in casing 72 (see FIG. 4*a*). As soon as the crossmembers 102 and 108 arise under the action of jacks 92 and 94, the lifters, freed from the action of rim 74*a*, pivot into a horizontal position under the action of their own weight (see FIG. 4*b*) or of a suitable control, for example a spring.

Figure 4B:
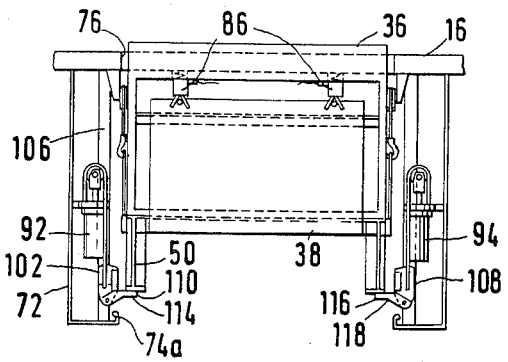
FIGS. 4*a*, 4*b*, and 4*c* are front elevation views showing the system for lifting the housing in different positions.
Figure 4A:
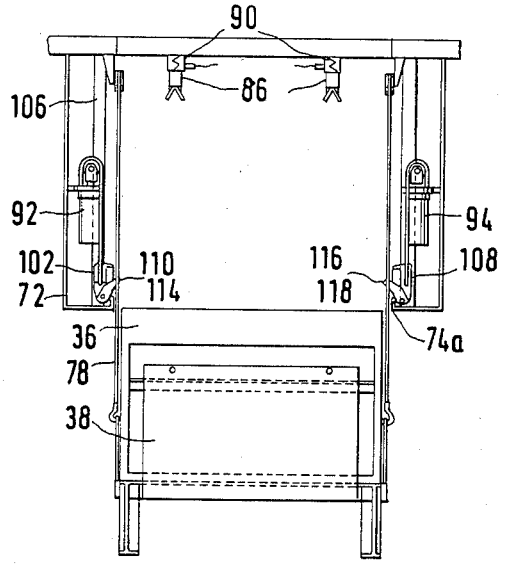

When housing 36 has reached the stand-by position illustrated in FIG. 4*b* under the action of the first lifting device, the second lifting device is actuated immediately in order to raise lifters 110, 114, 116, and 118 into the position supporting the legs of housing 36, as illustrated in FIG. 4*b*. This is a precautionary measure, because housing 36 may remain in this position for some time while waiting for depalletization of a pallet on platform 16.

Figure 4C:
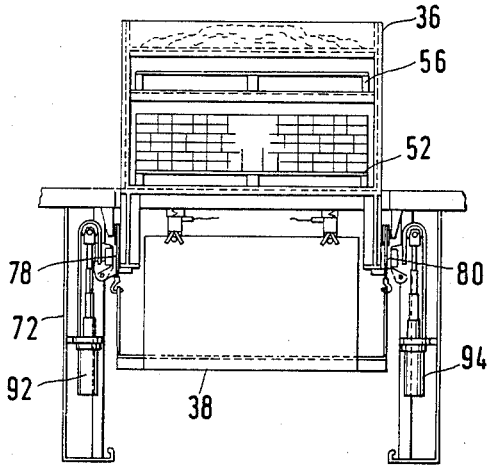

The continuation of the action of jacks 92 and 94 makes it possible to hoist housing 36 from the position illustrated in FIG. 4*b* towards the position shown in FIG. 4*c*, from which it is possible to extract the loaded pallet 52. It should be noted that, during the action of the second lifting device, housing 36 is removed from its basket 38, the latter remaining in the stand-by position attached to the cables 78, 80 of the first lifting device.

Two carriages 120 and 122 moving on two lateral rails 124 and 126 by means of rollers are arranged on platform 16. Each carriage has a fork 128 which can be engaged under a pallet (see FIG. 1). After housing 36 together with a loaded pallet 52 has been hoisted to the level shown in FIG. 4*c*, that one of the two carriages 120, 122 which is empty is shifted automatically or on command above orifice 76, so that its fork 128 penetrates under the pallet 52. When its fork 128 is completely engaged under pallet 52, the second lifting device is released slightly, until pallet 52 is supported by fork 128 and no longer bears on lower shelf 44 of housing 36. Carriage 120 and 122 is then once again shifted towards its initial position, taking the pallet with it out of housing 36.

Each of carriages 120 and 122 is associated with two position detectors 130 and 132 intended for monitoring the lateral position and longitudinal position of the pallet and of its bricks. These detectors, which can be mechanical detectors or light-beam detectors, serve to check whether the position of the pallet is correct and in compliance with the program of the robot 34 and; if appropriate, serve for controlling a correction in the position of carriages 120 and 122, and/or in the operation of the robot.

FIGS. 1 and 2 also show a control booth 134 enabling an operator to control, under cover, the various operations taking place automatically on platform 16 and, if appropriate, to take action if the need arises. This booth can be air-conditioned to provide the best possible working conditions.

The mode of operation of the apparatus of the present invention is readily apparent from the above detailed description and will only be discussed briefly below. When housing 36 is lowered from platform 16 with an empty pallet, turntable 32 is oriented so as to correspond to the angular position of platform 16, in order to receive basket 38 and housing 36. Turntable 32 is rotated into its initial position to remove the empty pallet 56 and immediately put a full pallet 52 into the lower compartment of housing 36. After turntable 32 has been rotated towards the angular position corresponding to that of platform 16, basket 38 and pallet-holder housing 36 are raised to the stand-by position, attached to cables 78 and 80, and resting on lifters 110, 114, 116, 118 by means of legs 50, until one of the two pallets 26, 28 is empty and has to be replaced.

There are many advantages in bringing the housing into the stand-by position of FIG. 4*b* as soon as possible. The change of pallet can be made immediately, as soon as the pallet to be changed is empty, so that there is a minimum loss of time.

For the entire time that housing 36 occupies the stand-by position, the orifice 76 is automatically closed off, thus reducing the danger of an accident. Subsequently, all the bricks 58 which cannot be used, for whatever reason, can be placed in container 48 of housing 36, so that the space available on platform 16 can be utilized as efficiently as possible.

As soon as the pallet 26 or 28 to be changed is empty or is being emptied, housing 36 is hoisted out of basket 36 by means of lifters 110, 114, 116 and 118 into an intermediate position between those of FIGS. 4*b* and 4*c*, in which the upper compartment of housing 36 is level with platform 16. The particular carriage 120 or 122 which carries the empty pallet is subsequently actuated in order to place it in the upper compartment of housing 36. After the carriage has been retracted from this upper compartment, housing 36 is hoisted up to the level of FIG. 4*c*, and in this position the full pallet 52 can be removed, as described above.

The operations of loading the empty pallet 56 or unloading the full pallet 52 can be carried out automatically or at the command of the operator located in the control booth 134.

As soon as the full pallet 52 is extracted from housing 36, the latter is lowered into its bracket 36, once again as a result of the lowering of the lifters 110, 114, 116 and 118. From the position shown in FIG. 4*b*, the housing 36 is taken up by the cables 78, and 80 of the first lifting device, while the lifters are lowered into the position of FIG. 4*a* in order to be retained under the action of rim 74*a* and to allow the passage of basket 38 and housing 36 which are lowered immediately afterwards as a result of the unwinding of cables 78 and 80.

It will be appreciated that although described with reference to a supported platform with pallets loaded from the bottom, the present invention applies equally to suspended platforms with pallets loaded from the top.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for lining the inner wall of a vessel with bricks comprising:

a work platform vertically movable within the vessel and capable of rotating about the vertical axis of the vessel, said work platform including two brick-pallet storage areas and automatic means for manipulating and laying bricks;

pallet-holder housing means including at least two superimposed compartments for respectively receiving a full pallet and an empty pallet;

basket means for carrying said housing means;

lifting means for raising or lowering said basket means, together with said pallet-holder housing means, to the level of said work platform and for releasing said pallet-holder housing means from said basket means; and means for placing an empty pallet in said housing means and removing a full pallet therefrom.

2. Apparatus according to claim 1 wherein said work platform has a central orifice and wherein said lifting means comprises:

a first lifting device mounted under said platform in order to raise said basket means and said housing, together with a pallet of bricks, towards a stand-by position below said platform; and a second lifting device mounted under said platform in order to remove said pallet-holder housing means from said basket means and hoist it through said central orifice in said platform, up to the level of said platform.

3. Apparatus according to claim 2 wherein said pallet-holder housing means comprises:

a rack with four legs, said rack having a depth substantially equal to the length of a pallet, said rack including a lower compartment for the full pallets and an upper compartment for the empty pallets.

4. Apparatus according to claim 3 wherein:

said housing means has an upper portion including a container for receiving bricks which cannot be used.

5. Apparatus according to claim 3 wherein said basket means comprises:

a rectangular floor corresponding substantially to the horizontal cross-section of said housing means, said floor having four corners with notches therein for the passage of said legs of said housing means, two vertical panels located on opposing longitudinal sides of said floor, said panels having a height at least equal to the height of the lower compartment of said housing means, and lugs on the opposing lateral sides of said floor for attaching lifting cables from said first lifting device.

6. Apparatus according to claim 5 wherein:

said vertical panels of said basket means have a height corresponding to the sum of the height of the lower compartment and about half the height of the upper compartment of said housing means.

7. Apparatus according to claim 5 wherein:

said lugs of said basket have a height whereby the level of fastening to the cables is located above the center of gravity of the empty housing means.

8. Apparatus according to claim 5 including:

limit detectors arranged on the lower edge of said central orifice in said platform and acutated by fingers arranged at corresponding locations on the upper edges of said longitudinal panels of said basket means, in order to determine the stand-by position and automatically control stopping of said first lifting device when said stand-by position is reached.

9. Apparatus according to claim 8 including:

four limit detectors and corresponding fingers which form a portion of a monitoring circuit thereby making it possible to determine whether the four detectors have been simultaneously actuated.

10. Apparatus according to claim 3 wherein said second lifting device comprises:

two pairs of lifters arranged at locations corresponding respectively to the positions of said four legs of said pallet-holder housing means, when the latter is in the stand-by position, and sliding vertically along two pairs of rails under the action of jack means.

11. Apparatus according to claim 10 wherein:

each pair of lifters is pivotably mounted on a cross-member so as to occupy a raised position aside from said legs of said housing means when said second lifting device is not actuated.

12. Apparatus according to claim 1 wherein:

said platform is mounted on a supporting ring carried by telescopic masts by means of a bearing.

13. Apparatus according to claim 12 including:

turntable means which rests on the work floor in the vertical axis of said orifice in said platform, the rotation of which is synchronized with that of said platform, but which returns to an initial angular position after each rotation.

14. Apparatus according to claim 1 including:

two carriage means which move along two rails arranged on either side of said orifice on said platform.

15. Apparatus according to claim 14 wherein:

each carriage means has a fork for engagement under the pallets located in said housing.

16. Apparatus according to claim 14 wherein:

each carriage means is associated with at least two position detector means.

17. Apparatus according to claim 12 wherein;

said supporting ring has radial props for bearing against the wall of the vessel to be bricked and for stabilizing said platform.

18. Apparatus according to claim 2 wherein:

said first and second lifting devices are mounted in a cylindrical casing which is located under said platform, the bottom of said casing having an orifice corresponding to said orifice in said platform, said pair of orifices being mutually coaxial.

19. Apparatus according to claim 8 wherein:

each of said limit detectors is associated with a shock-absorber.

20. Apparatus according to claim 2 wherein said first lifting device comprises:

a first cable associated with winch means, said first cable adapted for attachment to said basket means; and a second cable associated with winch means, said second cable adpated for attachment to said basket means.

* * * * *